US007145590B2

(12) United States Patent
Takagi et al.

(10) Patent No.: US 7,145,590 B2
(45) Date of Patent: Dec. 5, 2006

(54) APPARATUS WITH OFFSET LIGHT SOURCE FOR FORMING IMAGES ON PHOTOSENSITIVE SURFACE

(75) Inventors: Tomitaka Takagi, Osaka (JP); Koichiro Iki, Osaka (JP)

(73) Assignee: Nippon Sheet Glass Co., Ltd. (JP)

( * ) Notice: Subject to any disclaimer, the term of this patent is extended or adjusted under 35 U.S.C. 154(b) by 0 days.

(21) Appl. No.: 10/327,218

(22) Filed: Dec. 23, 2002

(65) Prior Publication Data

US 2003/0122920 A1 Jul. 3, 2003

(30) Foreign Application Priority Data

Dec. 28, 2001 (JP) ..... 2001-401307

(51) Int. Cl.
*B41J 27/00* (2006.01)

(52) U.S. Cl. ..... 347/244; 347/258

(58) Field of Classification Search ..... 347/238, 347/241, 244, 256, 258, 130; 349/95; 359/652–654; 385/119; 399/201–203, 212–215, 220–221, 399/197

See application file for complete search history.

(56) References Cited

U.S. PATENT DOCUMENTS 4,447,126 A * 5/1984 Heidrich et al. ..... 385/119
4,947,195 A 8/1990 Flynn et al. ..... 346/155
6,340,982 B1 * 1/2002 Taira et al. ..... 347/130

FOREIGN PATENT DOCUMENTS

| | | | |
|---|---|---|---|
| EP | 0 786 353 A1 | | 7/1997 |
| JP | 62-265859 | | 11/1987 |
| JP | 1-76245 | | 5/1989 |
| JP | 08-104027 | | 4/1996 |
| JP | 09-011534 | | 1/1997 |
| JP | 09052385 A | * | 2/1997 |
| JP | 10-309822 | | 11/1998 |
| JP | 10-309826 | | 11/1998 |
| JP | 2001-018451 | | 1/2001 |
| JP | 2001-113744 | | 4/2001 |
| JP | 2001-138571 | | 5/2001 |
| JP | 2002331705 A | * | 11/2002 |
| WO | WO 96/11110 | | 4/1996 |

* cited by examiner

*Primary Examiner*—Hai Pham
(74) *Attorney, Agent, or Firm*—Fish & Richardson P.C.

(57) ABSTRACT

Disclosed is an image forming apparatus which provides an image of an excellent quality which has a less variation in resolution and suppressed linear irregularity. A rod lens array includes two rows of rod lenses stacked one on the other. An LED array is offset by a predetermined offset amount from a plane passing the median position between the first row of rod lenses and the second row of rod lenses. This structure can realize an LED printer head which reduces a variation in the resolution of the rod lens array, thereby suppressing linear irregularity, and can thus provide an image having an excellent quality.

7 Claims, 4 Drawing Sheets

APPARATUS WITH OFFSET LIGHT SOURCE FOR FORMING IMAGES ON PHOTOSENSITIVE SURFACE

CROSS REFERENCE TO RELATED APPLICATIONS

Pursuant to 35 USC § 119, this application claims the benefit of Japan Patent Application No. 2001-401307 filed Dec. 28, 2001.

BACKGROUND OF THE INVENTION

The present invention relates to an image forming apparatus, and, more particularly, to an image forming apparatus, such as an light emitting diode (LED) printer head, which forms an image on a photosensitive surface by forming the image of light information from an LED array having a plurality of point light sources by a lens array.

A conventional LED printer head includes an LED array having a plurality of LEDs and a lens array which forms an image on a photosensitive surface by forming the image of light information irradiated from the LED array. The lens array comprises two rows of a plurality of gradient index rod lenses. Each rod lens forms the image of light information within a limited range. The lens array forms a total image by overlapping images formed by the lenses.

As shown in FIG. 8, the conventional LED printer head had to adjust the positions of the LED array and a lens array 110 in such a way that LEDs 100 would be positioned on the median plane C of the two rows of rod lenses. For example, Japanese Laid-Open Patent Publication No. 10-309826 discloses an image forming apparatus which is so designed as not to be easily influenced by the mounting errors of the LED array and the lens array in order to eliminate the troublesome position adjustment.

If the resolution of the lens array in an LED printer head which forms an image by causing a plurality of LEDs to emit light in various patterns differs at various locations, i.e., if the resolution of the lens array has a large variation, a linear irregularity occurs in the amount of light. The irregular amount of light results in the formation of uneven point images on the image forming surface, which makes the amount of toner adhered uneven, thereby resulting in uneven printing. A variation in the amounts of lights from the LEDs can be adjusted by compensating for the amount of light from each LED based on the light amount distribution of the surface of an image that has been measured in advance. Because a variation in the resolution of the lens array is a variation in a light amount profile (light amount distribution of a point image), however, the variation cannot be corrected by changing the brightness of the light sources. It is therefore difficult to compensate for a variation in the resolution of the lens array.

SUMMARY OF THE INVENTION

It is an object of the present invention to provide an image forming apparatus which forms an image of an excellent quality which does not have linear irregularity.

To achieve the above object, the present invention provides an image forming apparatus having a point light source array including a plurality of point light sources arranged in a line, and a lens array located to face the point light source array and including first and second rows of gradient index rod lenses. The point light sources are offset by a predetermined offset amount from the median position between the first row of rod lenses and the second row of rod lenses.

A further perspective of the present invention is a light emitting diode printer head having a first row of gradient index rod lenses, a second row of gradient index rod lenses stacked on the first row of gradient index rod lenses, and a plurality of light emitting diodes. The light emitting diodes is located to face the gradient index rod lenses and is offset by 18 micrometers to 200 micrometers from the median position between the first row of rod lenses and the second row of rod lenses.

A further perspective of the present invention is a method for manufacturing an image forming apparatus. The method includes preparing a lens array including first and second rows of gradient index rod lenses and a point light source array including an array of point light sources, which are activated in accordance with an image signal, and arranging the array of point light sources to be offset by a predetermined offset amount from the median position between an optical axis of the first row of rod lenses and an optical axis of the second row of rod lenses.

Other aspects and advantages of the present invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENT

An LED printer 11 and an LED printer head 13 according to one embodiment of the present invention will be described below referring to the accompanying drawings.

Figure 3:
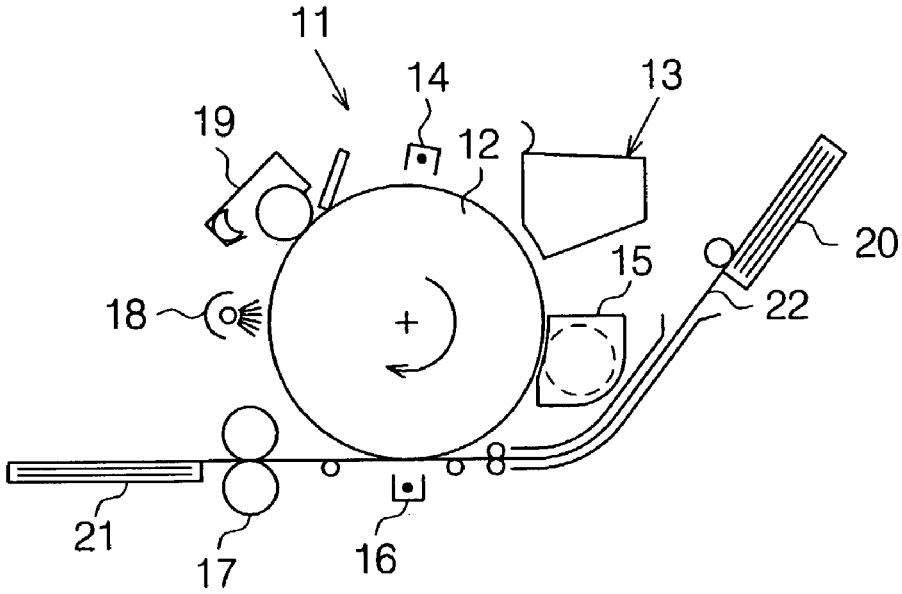
FIG. 3 is a schematic diagram of an LED printer which uses the LED printer head in FIG. 2.

As shown in FIG. 3, the LED printer 11 includes a cylindrical photosensitive drum 12, the LED printer head 13, a charging unit 14, a developing unit 15, a transfer unit 16, a fixing unit 17, a neutralization lamp 18, a cleaning unit 19, a sheet cassette 20 and a stacker 21. The peripheral surface of the photosensitive drum 12 is formed of a material having a photoconductivity (photosensitive material), such as amorphous silicon. The photosensitive drum 12 is rotated in accordance with the speed of printing. The charging unit 14 evenly charges the photosensitive surface of the photosensitive drum 12. The LED printer head 13 irradiates light of a dot image to be printed on the photosensitive surface of the photosensitive drum 12. This neutralizes charging at a portion where the light hits. The developing unit 15 supplies toner to charged portions of the photosensitive surface. The transfer unit 16 transfers the toner onto paper 22 supplied from the sheet cassette 20. The fixing unit 17 heats up the paper 22 to fix the toner. The stacker 21 receives the image-printed paper 22. The neutralization lamp 18 neutralizes charging of the photosensitive drum 12 after transfer. The cleaning unit 19 cleans the toner off the photosensitive drum 12.

Figure 1:
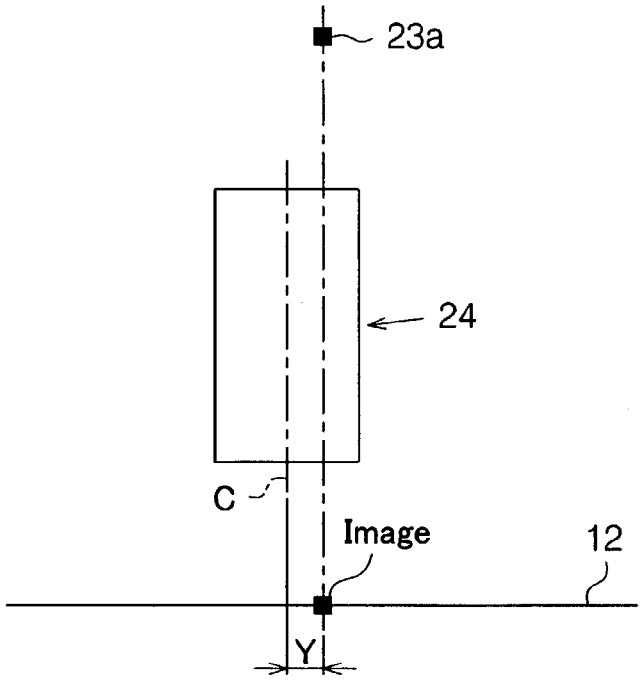
FIG. 1 is a side view showing the layout of an array of LEDs and a lens array in an LED printer head according to the present invention.
Figure 2:
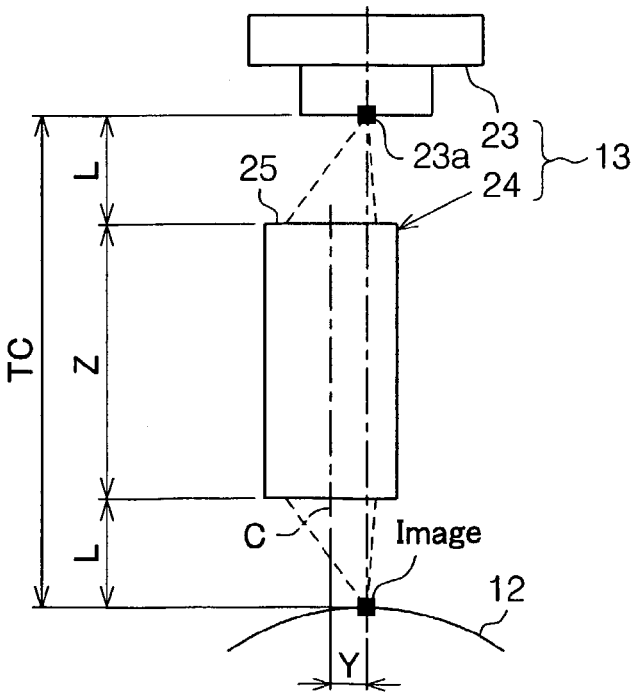
FIG. 2 is a schematic side view of an LED printer head according to one embodiment of the present invention.

Referring to FIG. 2, the LED printer head 13 will be discussed below. The LED printer head 13 includes an LED array 23 having a plurality of LEDs (point light sources) which are activated in accordance with an image signal and selectively emit light, and a rod lens array 24. The distance, L, between the rod lens array 24 and the LED array 23 is equal to the distance between the rod lens array 24 and the photosensitive surface of the photosensitive drum 12.

The LED array 23 is a module including an LED array chip and an IC driver chip both mounted on a substrate. In a case where the LED array 23 is for 1200 dpi (24 line pairs/mm), a plurality of LEDs are formed at a pitch of approximately 21.2 micrometers. The individual LEDs are turned on or off in accordance with an image signal.

Figure 5:
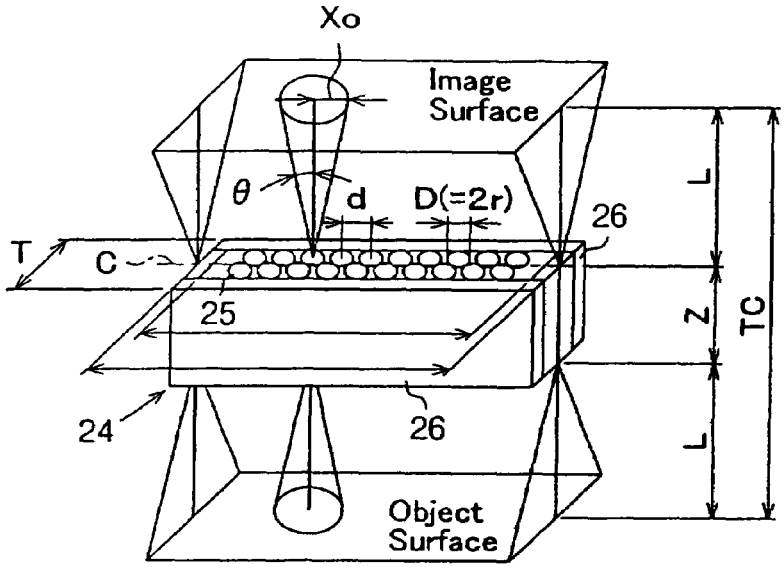
FIG. 5 is a diagram showing how an image is formed by a lens array in FIG. 2.

The rod lens array 24 forms an image comprised of a plurality of point images on the photosensitive surface of the photosensitive drum 12 (the image surface in FIG. 5) by forming the image of lights output from the LEDs (the object surface in FIG. 5). Each rod lens forms the image of output light within a limited range. The image of the rod lens array 24 is the images of plural rod lenses 25 which are overlapped one on another. The symbols in FIG. 5 are such that Z is the length of the lens, L is a working distance or the distance between the end face of the lens to the object surface or the image surface, TC is a total conjugate length or Z+2 L, X0 is the radius of the visual field of each rod lens 25, d is the horizontal interval of the rod lenses 25 and θ is an output angle.

Figure 4:
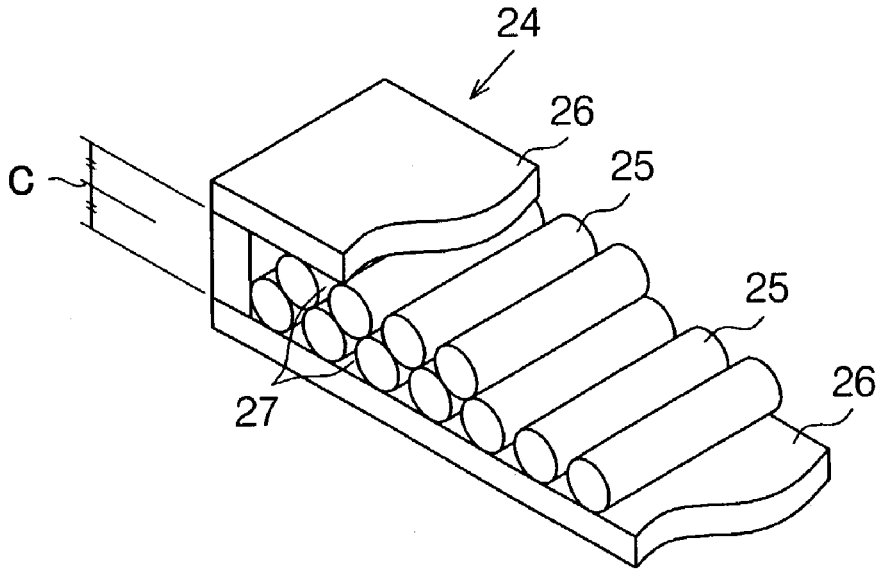
FIG. 4 is a perspective view showing a lens array for the LED printer head in FIG. 2.

As shown in FIGS. 4 and 5, the rod lens array 24 has two frames 26 and a plurality of rod lenses 25 stacked zigzag in two rows between the frames 26. The rod lenses 25 are of a gradient index type and have different refractive indexes in the radial direction. In each row of rod lenses 25, the rod lenses 25 are laid out at a predetermined interval from an adjoining rod lens 25. The gaps between the rod lenses 25 are filled with a black silicone resin 27 to eliminate flare light. In FIG. 4, the LED array 23 is located to the right of the rod lens array 24 and the photosensitive drum 12 is located to the left.

The LED array 23 has a plurality of LEDs laid out in a line at a predetermined pitch. The pitch is about 21.2 micrometers for the LED printer head 13 for 1200 dpi. In FIG. 2, a row of LEDs 23*a* is perpendicular to the surface of the paper. The end face of the rod lens array 24 is laid out so as to face the LEDs. That is, the optical axis (longitudinal axis) of each rod lens 25 is parallel to the sheet of FIG. 2, and the plural rod lenses 25 are laid out on the left row and the right row in FIG. 2. The row of LEDs 23*a* is offset by a predetermined offset amount Y from a plane C which passes the median position between the optical axis of the left row of rod lenses 25 and the optical axis of the right row of rod lenses 25. Specifically, the row of LEDs 23*a* is laid out eccentric to the right row of rod lenses 25. This can allow the LED printer head 13 to form an image of an excellent quality free of linear irregularity.

The following will discuss the offset amount Y. It is preferable that the offset amount Y should be set within a range defined by an equation 1 given below.

$$0.5p\times(X0/d)\leqq Y\leqq 2.5p\times(X0/d) \quad (1)$$

where p is the pitch of the LEDs, X0 is the radius of the visual field of each rod lens 25 and d is the lens interval between the rod lenses 25 in each row. The term "X0/d" is called the overlapping degree that indicates the degree of overlapping of images formed by the adjoining lenses and is a parameter which represents the performance of the rod lens array.

In case of the LED printer head 13 for 1200 dpi, for example, the pitch p is 21.2 micrometers (25400 micrometers/1200 dots). In case of using the rod lens array 24 whose overlapping degree m is 1.7, therefore, the desirable offset amount Y lies in a range of about 18 micrometers to about 90 micrometers. In case of using the rod lens array 24 whose overlapping degree m is 1.9, the desirable offset amount Y lies in a range of about 20 micrometers to about 100 micrometers.

In case of the LED printer head 13 for 600 dpi, for example, the pitch p is 42.4 micrometers (25400 micrometers/600 dots). In case of using the rod lens array 24 whose overlapping degree m is 1.7, therefore, the desirable offset amount Y lies in a range of about 36 micrometers to about 180 micrometers. In case of using the rod lens array 24 whose overlapping degree m is 1.9, the desirable offset amount Y lies in a range of about 40 micrometers to about 200 micrometers.

This embodiment has the following advantages.

The row of LEDs 23*a* is offset by the predetermined offset amount Y from the median plane C of the rod lens array 24. This reduces a variation in the resolution of the rod lens array 24, thereby suppressing a variation in point images on the image forming surface so that a variation in the amount of toner adhered becomes smaller. It is therefore possible to realize an LED printer head which has linear irregularity reduced to thereby ensure an excellent image quality.

The reduction in a variation in resolution will be discussed by referring to FIGS. 6A, 6B, 7A and 7B. A variation in resolution is measured by MTFσ. MTF (Modulation Transfer Function) is the index of the resolution of a rod lens array and MTFσ is the standard deviation of the MTF of the rod lens array. The smaller the MTFσ is, the less the linear irregularly becomes.

The horizontal scales in FIGS. 6A through 7B represent the offset amount Y and the vertical scales represent MTFσ.

Figure 6A:
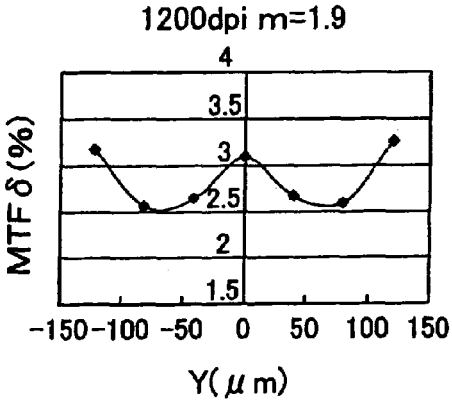
FIGS. 6A and 6B are graphs showing the relationships between MTFσ and an offset amount in case of a lens array having an overlapping degree m of 1.9.

FIG. 6A shows the measuring results for the LED printer head 13 of 1200 dpi which uses the rod lens array 24 with an overlapping degree m of 1.9. It is apparent that in a case where the offset amount is set to about 20 micrometers to 100 micrometers, MTFσ becomes less than 3 and an excellent image quality with linear irregularity reduced can be acquired. In other words, if the offset amount Y is smaller than 20 micrometers, MTFσ exceeds 3 which is not desirable. If the offset amount Y is greater than about 100 micrometers, MTFσ also exceeds 3 which is undesirable.

Figure 6B:
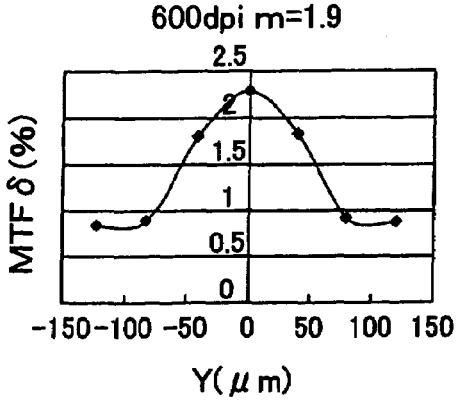

FIG. 6B shows the measuring results for the LED printer head 13 of 600 dpi which uses the rod lens array 24 with an overlapping degree m of 1.9. It is apparent that in a case where the offset amount Y is set to about 40 micrometers to 200 micrometers, MTFσ becomes less than 2 and an excellent image quality with linear irregularity reduced can be acquired. In other words, if the offset amount is smaller than 40 micrometers, MTFσ exceeds 2 which is not desirable.

In a case where MTFσ is originally small as in this example, the row of LEDs 23*a* need not be offset. Setting the offset amount Y in a range of approximately 40 micrometers to 200 micrometers can however make a variation in resolution smaller, thereby reducing linear irregularity. This can ensure a higher image quality.

Figure 7A:
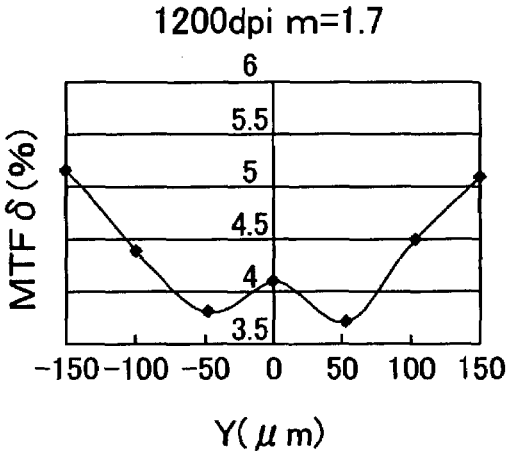
FIGS. 7A and 7B are graphs showing the relationships between MTFσ and the offset amount in case of a lens array having an overlapping degree m of 1.7.

FIG. 7A shows the measuring results for the LED printer head 13 of 1200 dpi which uses the rod lens array 24 with an overlapping degree m of 1.7. It is apparent that in a case where the offset amount Y is set to approximately 18 micrometers to 90 micrometers, MTFσ becomes less than 4 and an excellent image quality with linear irregularity reduced can be acquired. In other words, if the offset amount is smaller than 18 micrometers, MTFσ exceeds 4 which is not desirable. If the offset amount is greater than approximately 90 micrometers, MTFσ also exceeds 4 which is undesirable.

Figure 7B:
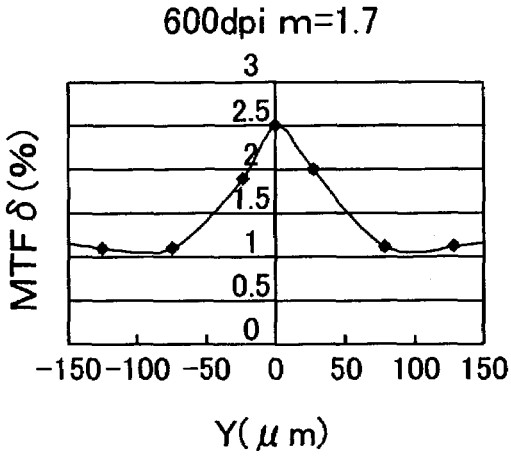
Figure 8:
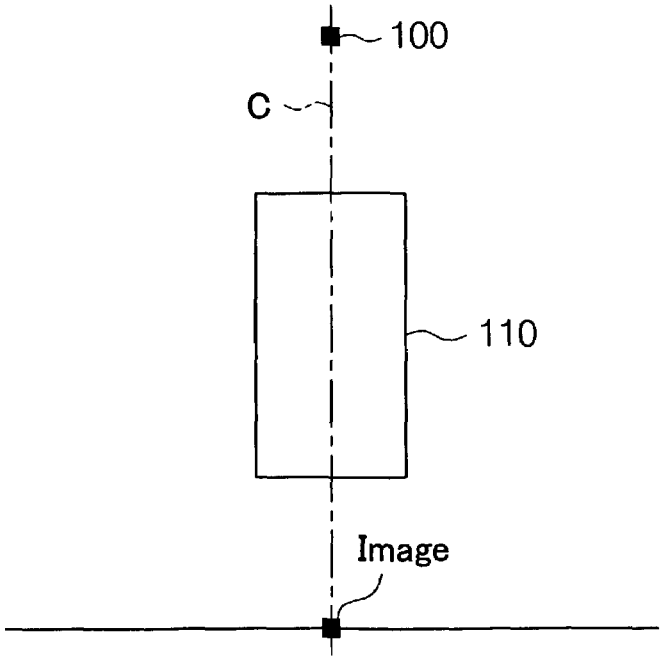
Fig.8 (Prior Art)
FIG. 8 is a side view showing the layout of the array of LEDs and the lens array in the conventional LED printer head.

FIG. 7B shows the measuring results for the LED printer head 13 of 600 dpi which uses the rod lens array 24 with an overlapping degree m of 1.7. It is apparent that in a case where the offset amount is set to approximately 36 micrometers to 180 micrometers, MTFσ becomes less than 2 and an excellent image quality with linear irregularity reduced can be acquired. In other words, if the offset amount is smaller than 36 micrometers, MTFσ exceeds 2 which is not desirable. In a case where MTFσ is originally small as in this example, however, the row of LEDs 23*a* need not be offset. Setting the offset amount Y in a range of approximately 36 micrometers to 180 micrometers can make a variation in resolution smaller, thereby reducing linear irregularity. This can ensure a higher image quality.

It is apparent from the results shown in FIGS. 6A and 7A that the effect of reducing a variation in the resolution of the rod lens array 24 is significant in case of an LED printer head which forms an image with a higher recording density. The invention therefore demonstrates an outstanding advantage particularly in an image forming apparatus whose recording density is high.

It should be apparent to those skilled in the art that the present invention may be embodied in many other specific forms without departing from the spirit or scope of the invention.

Although the row of LEDs 23*a* is offset to the right to the median plane C in FIG. 2, it may be offset to the left. As apparent from the results given in FIGS. 6A through 7B, a variation in resolution is reduced regardless of the direction of offset.

The present invention is also adaptable to a case where there are plural rows of LEDs. In case of two rows of LEDs, for example, the two rows of LEDs are offset from the median plane C by offset amounts Y1 and Y2, respectively. In this case, the rows of LEDs are offset to the same side from the median plane C.

In case of two rows of LEDs, one row of LEDs may be offset to the right to the median plane C and the other row of LEDs may be offset to the left by the same offset amount Y.

The light source array is not limited to the LED array 23. The light source array can take any form as long as it generates and kills light element by element or it passes and blocks light from an external light source pixel by pixel. The light source array is a light source, such as a light shutter array, which has a plurality of point light sources that selectively emit light in accordance with an image signal. The light shutter array includes a liquid crystal shutter array which passes and blocks light from a discharge tube pixel by pixel.

The present invention may be adapted to an optical writing head which comprises a liquid crystal shutter array and the rod lens array 24, instead of the LED printer head 13 which comprises the LED array 23 and the rod lens array 24. In this case, the printer is a liquid crystal shutter printer.

The present invention is not limited to an optical printer, such as the LED printer 11, it may be adapted to a copying machine and a complex machine equipped with a printer capability, a copying capability and a facsimile capability.

The present examples and embodiments are to be considered as illustrative and not restrictive and the invention is not to be limited to the details given herein, but may be modified within the scope and equivalence of the appended claims.

What is claimed is:

1. An image forming apparatus comprising:

an image forming surface;

a point light source array including a plurality of point light sources arranged in a line; and a lens array located between the image forming surface and the point light source array and including first and second rows of gradient index rod lenses, the lens array having a center line lying on a median plane between the first row of rod lenses and the second row of rod lenses, the point light sources being offset by a predetermined offset amount from a median position between the first row of rod lenses and the second row of rod lenses, the point light sources being asymmetrically offset with respect to an optical axis of the first row of rod lenses and an optical axis of the second row of rod lenses, and the center line being substantially parallel to a line connecting the point light source array to an image formed on the image forming surface, wherein the predetermined offset amount is in a range given by the equation:

$0.5p\times(X0/d)\leqq$offset amount$\leqq 2.5p\times(X0/d)$, where p is a pitch of the point light sources, X0 is a radius of a visual field of each of the gradient index rod lenses, and d is a lens interval between the gradient index rod lenses.

2. The image forming apparatus according to claim 1, wherein the point light sources are light emitting diodes and the point light source array is a light emitting diode array.

3. An image forming apparatus comprising:

an image forming surface;

a point light source array including an array of point light sources which are activated in accordance with an image signal; and a lens array located between the image forming surface and the point light source array for forming an image on the image forming surface according to light information from the point light source array, the lens array including first and second rows of gradient index rod lenses, the lens array having a center line lying on a plane passing through a median position between an optical axis of the first row of rod lenses and an optical axis of the second row of rod lenses, the array of the point light sources being offset by a predetermined offset amount from said plane, the array of the point light sources being asymmetrically offset with respect to the optical axis of the first row of rod lenses and the optical axis of the second row of rod lenses, and the center line being substantially parallel to a line connecting the point light source array to the image formed on the image forming surface, wherein the predetermined offset amount is in a range given by the equation:

$0.5p\times(X0/d)\leqq$offset amount$\leqq 2.5p\times(X0/d)$, where p is a pitch of the point light sources, X0 is a radius of a visual field of each of the gradient index rod lenses, and d is a lens interval between the gradient index rod lenses.

4. A light emitting diode printer head for emitting light of an image to an image forming surface, the printer head comprising:

a first row of gradient index rod lenses;

a second row of gradient index rod lenses stacked on the first row of gradient index rod lenses; and a plurality of light emitting diodes located to face the gradient index rod lenses and being offset by 18 micrometers to 200 micrometers from a plane passing through a median position between the first row of rod lenses and the second row of rod lenses, the plurality of light emitting diodes being asymmetrically offset with respect to an optical axis of the first row of rod lenses and an optical axis of the second row of rod lenses, and said plane being substantially parallel to an imaginary plane that passes through the light emitting diodes and the image formed on the image forming surface, wherein the predetermined offset amount is in a range given by the equation:

$0.5p\times(X0/d)\leqq$offset amount$\leqq 2.5p\times(X0/d)$, where p is a pitch of the point light sources, X0 is a radius of a visual field of each of the gradient index rod lenses, and d is a lens interval between the gradient index rod lenses.

5. A method for manufacturing an image forming apparatus for forming an image on an image forming surface, the method comprising the steps of:

preparing a lens array including first and second rows of gradient index rod lenses and a point light source array including an array of point light sources, which are activated in accordance with an image signal, wherein the lens array has a center line lying on a plane passing through a median position between an optical axis of the first row of rod lenses and an optical axis of the second row of rod lenses; and arranging the array of point light sources to be offset by a predetermined offset amount from said plane so that said center line is substantially parallel to a line connecting the point light source array to the image formed on the image forming surface, the array of point light sources being asymmetrically offset with respect to the optical axis of the first row of rod lenses and the optical axis of the second row of rod lenses, and adjusting the predetermined offset amount in a range given by the equation:

$0.5p\times(X0/d)\leqq$offset amount$\leqq 2.5p\times(X0/d)$, where p is a pitch of the point light sources, X0 is a radius of a visual field of each of the gradient index rod lenses, and d is a lens interval between the gradient index rod lenses.

6. An image forming apparatus comprising:

an image forming surface;

a point light source array comprising only a single row of point light sources; and a lens array located between the image forming surface and the point light source array, the lens array comprising only two rows of gradient index rod lenses including a first row of gradient index rod lenses and a second row of gradient index rod lenses, the lens array having a center line, lying on a median plane between the first row of rod lenses and the second row of rod lenses, that is substantially parallel to a line connecting the point light source array to an image formed on the image forming surface, the row of point light sources being asymmetrically offset with respect to the first row of rod lenses and the second row of rod lenses, wherein the predetermined offset amount is in a range given by the equation:

$0.5p\times(X0/d)\leqq$offset amount$\leqq 2.5p\times(X0/d)$, where p is a pitch of the point light sources, X0 is a radius of a visual field of each of the gradient index rod lenses, and d is a lens interval between the gradient index rod lenses.

7. A method for manufacturing an image forming apparatus for forming an image on an image forming surface, the method comprising the steps of:

preparing a lens array comprising only two rows of gradient index rod lenses including a first row of gradient index rod lenses and a second row of gradient index rod lenses, the lens array having a center line lying on a plane passing through a median position between an optical axis of the first row of rod lenses and an optical axis of the second row of rod lenses;

arranging a single row of point light sources to be asymmetrically offset with respect to the optical axis of the first row of rod lenses and the optical axis of the second row of rod lenses, where the center line is substantially parallel to a line connecting the row of point light sources to the image on the image forming surface; and adjusting the predetermined offset amount is in a range given by the equation:

$0.5p\times(X0/d)\leqq$offset amount$\leqq 2.5p\times(X0/d)$, where p is a pitch of the point light sources, X0 is a radius of a visual field of each of the gradient index rod lenses, and d is a lens interval between the gradient index rod lenses.

* * * * *